US006863014B2

(12) United States Patent
Hudson et al.

(10) Patent No.: US 6,863,014 B2
(45) Date of Patent: Mar. 8, 2005

(54) INFLATABLE KAYAK

(75) Inventors: Rex Hudson, Port Isabel, TX (US); Wes Hudson, Port Isabel, TX (US)

(73) Assignee: Shallow Sport Boats of Texas, Inc., Port Isabel, TX (US)

( * ) Notice: Subject to any disclaimer, the term of this patent is extended or adjusted under 35 U.S.C. 154(b) by 0 days.

(21) Appl. No.: 10/721,430

(22) Filed: Nov. 25, 2003

(65) Prior Publication Data

US 2004/0107889 A1 Jun. 10, 2004

Related U.S. Application Data

(60) Provisional application No. 60/429,204, filed on Nov. 26, 2002.

(51) Int. Cl.[7] ..... B63B 35/00
(52) U.S. Cl. ..... 114/347; 114/345
(58) Field of Search ..... 114/345, 347, 114/354; D12/302, 316

(56) References Cited

U.S. PATENT DOCUMENTS

| | | | | | |
|---|---|---|---|---|---|
| 2,999,253 | A | * | 9/1961 | Lewis | 114/347 |
| 3,490,085 | A | | 1/1970 | Lewis | |
| 3,577,576 | A | | 5/1971 | Lobb et al. | |
| 4,031,580 | A | * | 6/1977 | Neumann et al. | 114/347 |
| 5,299,524 | A | * | 4/1994 | Szilagyi | 114/345 |
| 5,507,244 | A | | 4/1996 | Lee | |
| 6,035,799 | A | | 3/2000 | Lukanovich et al. | |
| 6,065,421 | A | * | 5/2000 | Haller et al. | 114/347 |
| D427,561 | S | * | 7/2000 | Haller et al. | D12/302 |
| 6,223,678 | B1 | * | 5/2001 | Haller et al. | 114/347 |
| D464,602 | S | * | 10/2002 | Metzger et al. | D12/302 |
| D465,447 | S | * | 11/2002 | Haller | D12/302 |
| 6,539,889 | B2 | * | 4/2003 | Simpson | 114/345 |

* cited by examiner

*Primary Examiner*—Lars A. Olson
(74) *Attorney, Agent, or Firm*—Jackson Walker L.L.P.; Richard R. Ruble

(57) ABSTRACT

The present invention provides an inflatable kayak having a first set of inflatable tubes defining a bottom portion for contracting a body of water. The bottom portion of the present invention is attached to one or more side walls defining the sides of the kayak. The kayak of the present invention is equipped with a first area sized to receive a surfboard and a zipper or other sealing system to secure the surfboard within the first area. The surfboard providing additional rigidity and stability to the kayak of the present invention.

19 Claims, 2 Drawing Sheets

INFLATABLE KAYAK

This patent application claims priority upon a provisional patent application entitled "Inflatable Kayak", Ser. No. 60/429,204, having a filing date of Nov. 26, 2002.

FIELD OF THE INVENTION

The present invention relates to an inflatable water craft and, more particularly to an inflatable kayak.

BACKGROUND OF THE INVENTION

Inflatable kayaks provide several benefits over noninflatable kayaks made from wood or fiberglass. In particular, inflatable kayaks are more portable than noninflatable kayaks and are safer to use. These advantages of inflatable kayaks result from several design differences between inflatable and noninflatable kayaks.

For example, noninflatable kayaks have a solid shell which cannot be collapsed or folded for portability. While noninflatable kayaks are relatively lightweight their relatively large size makes transporting them difficult. In contrast, inflatable kayaks can be deflated and folded up to a relatively compact size for portability.

Further, noninflatable kayaks have a deck which completely covers the kayak except for a hold through which the user fits. The user's legs extend into the space between the hull of the kayak and the deck, and the user wears a tight fitting apron which is secured around the edge of the hole in the kayak deck. In contrast, an inflatable kayak has no deck. The user simply sits in the inflatable kayak with his legs extended forward. Consequently, inflatable kayaks are safer to use than noninflatable kayaks because the user is not enclosed within the body of the kayak if the kayak turns over in the water.

Nevertheless, conventional inflatable kayaks suffer from several disadvantages. For instance, conventional kayaks often lack the rigidity required to allow the user to traverse rough terrain. Thus, many experienced kayak users prefer a noninflatable kayak that allows the user to traverse shallow water rapids and other challenging marine environments.

There remains a need for a portable, lightweight kayak having sufficient rigidity to traverse difficult marine environments.

SUMMARY OF THE INVENTION

Accordingly, the present invention provides an inflatable kayak comprising a plurality of tubes. When inflated with air, the tubes provide the kayak with a degree of buoyancy. This degree of buoyancy allows the kayak to float and be maneuvered in a relatively calm marine environment.

In one embodiment, the kayak of the present invention is equipped with an internal enclosure sized to receive a surfboard. The surfboard may be inserted and encapsulated within the internal enclosure to provide the present invention with increased rigidity and buoyant characteristics ideal for difficult marine environments.

Upon removal of the surfboard, the kayak of the present invention may be deflated and folded for convenient storage or transportation. In one embodiment, the present invention may be equipped with one or more handles or straps having a grasping portion for the convenience of the user.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawing, wherein.

DETAILED DESCRIPTION OF THE INVENTION

Figure 1:
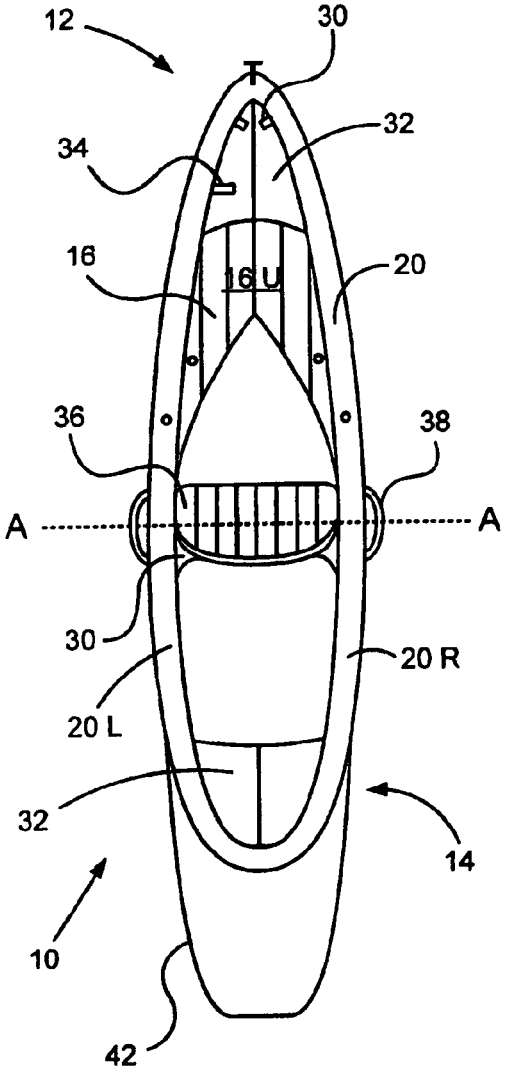
FIG. 1 is a plan view of one embodiment of the present invention illustrating the inclusion of a surfboard.
Figure 2:
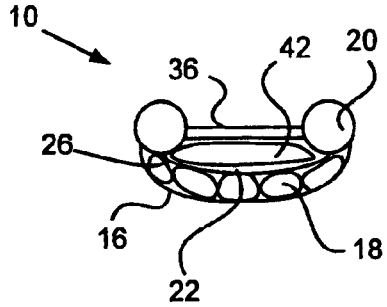
FIG. 2 is a cross sectional view of one embodiment of the present invention taken along line A—A of FIG. 4.
Figure 3A:
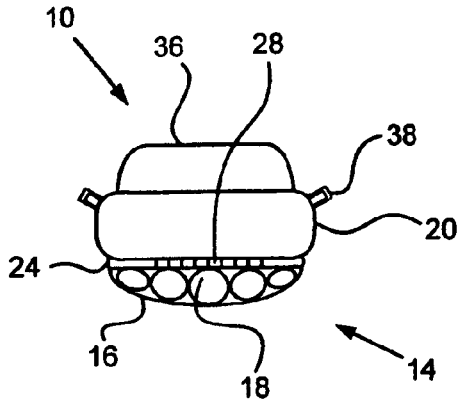
FIG. 3A is a rear elevation view of one embodiment of the present invention illustrating the enclosure in a closed position.
Figure 3B:
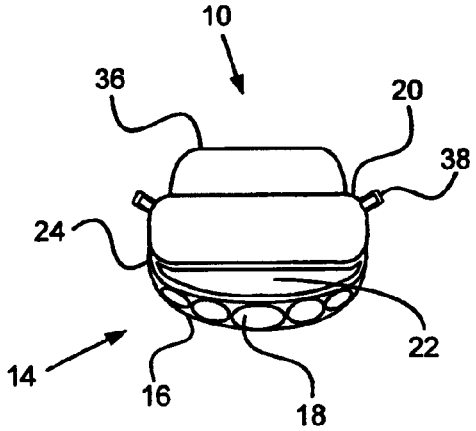
FIG. 3B is a rear elevation view of one embodiment of the present invention illustrating the enclosure in an open position.
Figure 4:
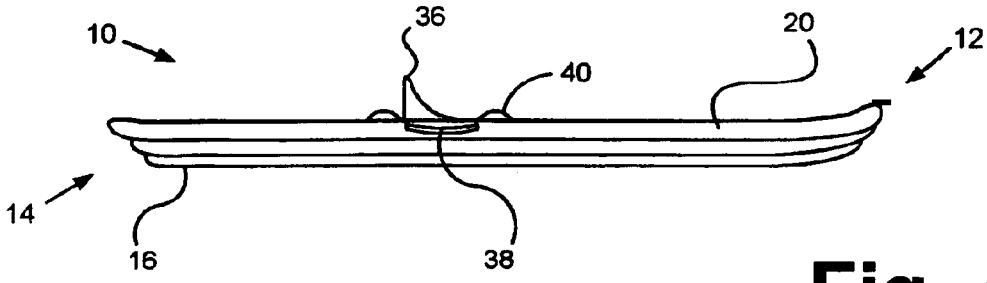
FIG. 4 is a side elevation view of one embodiment of the present invention.
Figure 5:
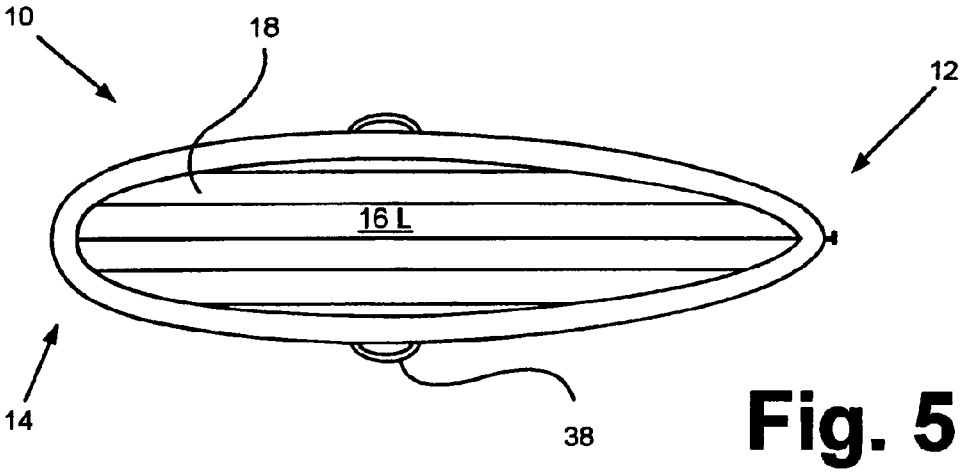
FIG. 5 is a bottom plan view of one embodiment of the present invention.
Figure 6:
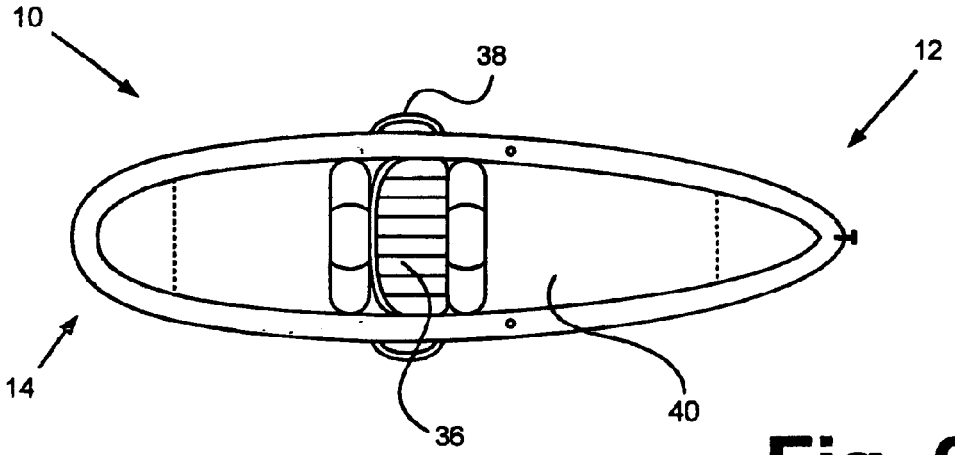
FIG. 6 is plan view of one embodiment of the present invention.

The present invention is herein described as a kayak (10) having bow (12) and stern (14) portions for floating on the surface of a body of water. Referring to FIGS. 1–6, the kayak (10) of the present invention has a bottom portion (16) having upper and lower surfaces (16U and 16L, respectively). In one embodiment, the bottom portion (16) of the kayak (10) utilizes a series of generally cylindrical, inflatable tubes (18). These tubes (18) traverse from the bow (12) to the stern (14) of the kayak and may be composed of welded plastic, welded vinyl or any other suitable material.

The bottom portion (16) of the present invention is attached to at least one side wall (20) extending in a generally perpendicular direction from the bottom portion. In one embodiment, the side wall, or gunwale, consists of left (20L) and right tubes (20R) designed to join at the bow and stern of the kayak (10). As with the bottom portion, the side wall (20) may comprise one or more generally cylindrical, inflatable tubes. These tubes may also be composed of welded plastic, welded vinyl, or any other suitable material.

In one embodiment, a seam (24) located between the bottom portion (16) and the side wall (20) is utilized to couple the bottom and sidewall portions together as well as provide a measure of elasticity for the insertion of the surfboard, given its relative dimensions. In short, the seam (24) may be composed of an elastic material to allow the present invention to accommodate a greater number of surfboard designs. The material utilized in the stern of the present invention may also be elastic such that it could be stretched over the stern of the surfboard to firmly hold the surfboard in place much like a pocket acting as a brace. The elastic material would allow for the use of differently sized surfboards.

To improve the resiliency characteristics of the present invention, wear strips (26) may be welded over the seam (24) between the side walls (20) and the bottom portion (16). In one embodiment, the wear strips consist of additional plastic or vinyl members that run the length of the kayak on the seams of the gunwales, and bottom portion. These wear strips are capable of preventing wear, tear, and rips which may occur due to abrasion and contact with rocks and other subsurface obstructions in or out of water.

The kayak of the present invention is designed to releasably engage a surfboard (42). Specifically, the user may insert a surfboard into a partial enclosure (22) formed by the bottom, side, and seat portions (16, 20 and 36, respectively) of the present invention. To accomplish this, the present invention provides an access opening through which the user may insert the surfboard into the enclosure. In one embodiment, the access opening is provided at the stern of the kayak to allow the user to insert the front portion of the surfboard (42) into the enclosure. However, it should be understood that the access opening may be provided at the bow or side positions of the kayak as well.

The present invention provides a zipper (28) or other suitable enclosure device to control access to and from the enclosure of the kayak. In one embodiment, the enclosure device is located between the bottom and side tubes of the kayak such that the edges of a surfboard inserted into the enclosure are held between the bottom portion and the side walls.

The present invention provides one or more surfboard retention members (30) for receiving and stabilizing the surfboard once inserted into the enclosure. In one embodiment, forward, rear, and central retention members are provided to "lock" the surfboard into the enclosure. In one embodiment, a clamping arrangement located in the bow (12) portion of the kayak is utilized to engage and releasably retain the front portion of the surfboard (42). Each retention member may also be equipped with a release mechanism (34) to allow for the removal of the surfboard from the kayak, when desired. In one embodiment, a release lever coupled to the clamping arrangement is housed within a waterproof storage compartment (32) for easy access.

A foldable seat (36) maybe attached to the side walls, the bottom portion, or both to provide the user with a comfortable and stable place to sit during use of the kayak. In one embodiment, the seat (36) may attach to a retention member located adjacent to the seat. As discussed above, the kayak of the present invention may be equipped with one or more watertight compartments capable of functioning as storage receptacles. In one embodiment, the retention members (30) described above may also be designed to retain personal items or other accessories, i.e., a retractable paddle, etc.

The distance between the bottom portion (16) and the sidewalls (20) may be adjusted based upon the length and width of the surfboard (42) used in conjunction with the present invention. Length and width of the present invention may also be adjusted, according to predetermined surfboard sizes, for instance, a 6–12 inch length difference depending on the size of the surfboard that will provide rigidity and additional buoyancy to the inflatable kayak.

The length and width of the inflatable kayak of the present invention may be predetermined for each particular user depending on the size of surfboard being utilized, often related to the user's size. In one embodiment, the inflatable kayak of the present invention is designed for the average size user and surfboard having dimensions of between about 6 and 12 feet long and about 40 inches wide.

In one embodiment, the present invention may be equipped with one or more handles (38) or straps having a grasping position for the convenience of the user. When inflated, the kayak of the present invention may be utilized as a surfboard carrying bag. This feature of the present invention allows transportation of the user's surfboard in a protective environment. In one embodiment, handles (38) or straps are provided that allow the kayak of the present invention to function, essentially, as a surfboard carrying backpack. Further, a cover (40) capable of substantially enclosing the deck portion of the kayak may be utilized. In one embodiment, the cover (40) is waterproof and capable of extending around the top side of the gunwales. In one embodiment, the cover may be equipped with supplemental zippers to accommodate the seat therethrough. The cover may be attachable by any known method including snaps or zippers.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

We claim:

1. A kayak, having a bow and a stem, for floating on a surface of a body of water comprising:

a bottom member for engaging said surface of said body of water, said bottom member comprising at least one inflatable member;

a side member attached to and extending substantially perpendicular from said bottom member, said side member and said bottom member defining an enclosure;

means for providing access to said enclosure; and wherein said enclosure is sized to receive a surfboard.

2. The kayak of claim 1, further comprising at least one seam located between said side member and said bottom member.

3. The kayak of claim 2, wherein said seam comprises an elastic material capable of expansion and contraction.

4. The kayak of claim 3, wherein said seam further comprises one or more wear strips.

5. The kayak of claim 1, wherein said means for controlling access to said enclosure comprises a zipper.

6. The kayak of claim 1, wherein said side member further comprises at least one retention member for releasably retaining a surfboard within said enclosure.

7. The kayak of claim 6, wherein said side member further comprises at least one waterproof storage container.

8. The kayak of claim 6, wherein said retention member comprises a clamping arrangement for engaging and releasably retaining said surfboard upon insertion into said enclosure.

9. The kayak of claim 7, further comprising a release member for releasing said surfboard from said retention member.

10. The kayak of claim 9, wherein said release member is positioned within said storage container.

11. The kayak of claim 1, wherein said side member further comprises a foldable seat.

12. The kayak of claim 1, wherein said side member further comprises one or more handles.

13. The kayak of claim 1, further comprising a waterproof cover.

14. The kayak of claim 1, wherein said bottom member comprises a set of inflatable tubes running from said stem to said bow of said kayak.

15. An inflatable kayak, having a bow and a stem, comprising:

at least one bottom member having an upper surface for engaging a user and a lower surface for engaging a surface of a body of water, said bottom member comprising a plurality of substantially cylindrical, inflatable tubes;

at least one side member attached to a seam attached to said upper surface of said bottom member, said side member extending substantially perpendicular from said bottom member, said side member comprising at least one substantially cylindrical, inflatable tube, wherein said bottom member and said side members form an enclosure sized to receive a surfboard; and wherein said seam comprises a plastic zipper for controlling access to said enclosure, said seam comprised of elastic material capable of expansion and contraction.

16. The kayak of claim 15, wherein said side member further comprises at least one retention member for releasably retaining said surfboard within said enclosure.

17. The kayak of claim 15, wherein said side member further comprises at least one waterproof storage container.

18. The kayak of claim 16, wherein said retention member comprises at least one clamping arrangement for engaging and releasably retaining said surfboard upon insertion into said enclosure.

19. The kayak of claim 15, wherein said side member further comprises one or more handles.

* * * * *